US006941246B2

(12) United States Patent
Raykar et al.

(10) Patent No.: US 6,941,246 B2
(45) Date of Patent: Sep. 6, 2005

(54) METHOD FOR THREE-DIMENSIONAL POSITION CALIBRATION OF AUDIO SENSORS AND ACTUATORS ON A DISTRIBUTED COMPUTING PLATFORM

(75) Inventors: Vikas C. Raykar, Hyattsville, MD (US); Rainer W. Lienhart, Santa Clara, CA (US); Igor V. Kozintsev, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 163 days.

(21) Appl. No.: 10/666,662

(22) Filed: Sep. 18, 2003

(65) Prior Publication Data

US 2005/0065740 A1 Mar. 24, 2005

(51) Int. Cl.[7] ..... G01C 17/00
(52) U.S. Cl. ..... 702/186; 340/825.25
(58) Field of Search ..... 702/186, 57, 75, 702/79, 94, 103, 104, 106, 150, 189, 176; 375/224; 340/146.2, 825.25, 7.1; 367/13, 99, 117; 118/125

(56) References Cited

U.S. PATENT DOCUMENTS 5,959,568 A * 9/1999 Woolley ..... 342/42

OTHER PUBLICATIONS

Bulusu, Nirupama, et al., Scalable Coordination for Wireless Sensor Networks: Self–Configuring Localization Systems, Proceedings of the 6th International Symposium on Communication Theory and Applications (ISCTA '01), Ambleside, Lake District, UK, Jul. 2001, 6 pages.

Girod, Lewis, et al., Locating tiny sensors in time and space: A case study, Proceedings of the 2002 IEEE International Conference on Computer Design: VLSI in Computers and Processors (ICCD '02), Freiburg, Germany, Sep. 16–18, 2002, 6 pages.

Moses, Randolph L., et al., A Self–Localization Method for Wireless Sensor Networks, EURASIP Journal on Applied Signal Processing 2003–4, © 2003 Hindawai Publishing Corporation, pp. 348–358.

Raykar, Vikas C., et al., Self Localization of acoustic sensors and actuators on Distributed platforms, Proceedings. 2003 International Workshop on Multimedia Technologies in E–Learning and Collaboration, Nice, France, Oct. 2003, 8 pages.

Sachar, Joshua M., et al., Position Calibration Of Lage–Aperture Microphone Arrays, 2002 IEEE International Conference on Acoustics, Speech, and Signal Processing, vol. 2, 2002, pp. 1797–1800.

Savvides, Andreas, et al., Dynamic Fine–Grained Localization in Ad–Hoc Networks of Sensors, in the proceedings of the International Conference on Mobile Computing and Networking (MobiCom) 2001, Rome, Italy, Jul. 2001, pp. 166–179.

* cited by examiner

*Primary Examiner*—Hal Wachsman
*Assistant Examiner*—Edward Raymond
(74) *Attorney, Agent, or Firm*—Blakely, Sokoloff, Taylor & Zafman LLP

(57) ABSTRACT

A method, machine readable medium, and system are disclosed. In one embodiment the method comprises generating an acoustic signal from an actuator of a first computing device, receiving the acoustic signal with a sensor of a second computing device, receiving the acoustic signal with a sensor of a third computing device, generating an estimate of a difference between the amount of time required for the acoustic signal to travel from the actuator of the first computing device to the sensor of the second computing device and the amount of time required for the acoustic signal to travel from the actuator of the first computing device to the sensor of the third computing device, wherein the sensors and actuator are unsynchronized, and computing, based on the estimated difference in time, a physical location of at least one of the said sensors and actuator.

35 Claims, 6 Drawing Sheets

METHOD FOR THREE-DIMENSIONAL POSITION CALIBRATION OF AUDIO SENSORS AND ACTUATORS ON A DISTRIBUTED COMPUTING PLATFORM

BACKGROUND OF THE INVENTION

Many emerging applications like multi-stream audio/video rendering, hands free voice communication, object localization, and speech enhancement, use multiple sensors and actuators (like multiple microphones/cameras and loudspeakers/displays, respectively). However, much of the current work has focused on setting up all the sensors and actuators on a single platform. Such a setup would require a lot of dedicated hardware. For example, to set up a microphone array on a single general purpose computer, would typically require expensive multichannel sound cards and a central processing unit (CPU) with larger computation power to process all the multiple streams.

Computing devices such as laptops, personal digital assistants (PDAs), tablets, cellular phones, and camcorders have become pervasive. These devices are equipped with audio-visual sensors (such as microphones and cameras) and actuators (such as loudspeakers and displays). The audio/video sensors on different devices can be used to form a distributed network of sensors. Such an ad-hoc network can be used to capture different audio-visual scenes (events such as business meetings, weddings, or public events) in a distributed fashion and then use all the multiple audio-visual streams for emerging applications. For example, one could imagine using the distributed microphone array formed by laptops of participants during a meeting in place of expensive stand alone speakerphones. Such a network of sensors can also be used to detect, identify, locate and track stationary or moving sources and objects.

To implement a distributed audio-visual I/O platform, includes placing the sensors, actuators and platforms into a space coordinate system, which includes determining the three-dimensional positions of the sensors and actuators.

BRIEF DESCRIPTION OF DRAWINGS

The present invention is illustrated by way of example and is not limited by the figures of the accompanying drawings, in which like references indicate similar elements, and in which.

DETAILED DESCRIPTION

Embodiments of a three-dimensional position calibration of audio sensors and actuators in a distributed computing platform are disclosed. In the following description, numerous specific details are set forth. However, it is understood that embodiments may be practiced without these specific details. In other instances, well-known circuits, structures and techniques have not been shown in detail in order not to obscure the understanding of this description.

Reference throughout this specification to "one embodiment" or "an embodiment" indicate that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1:
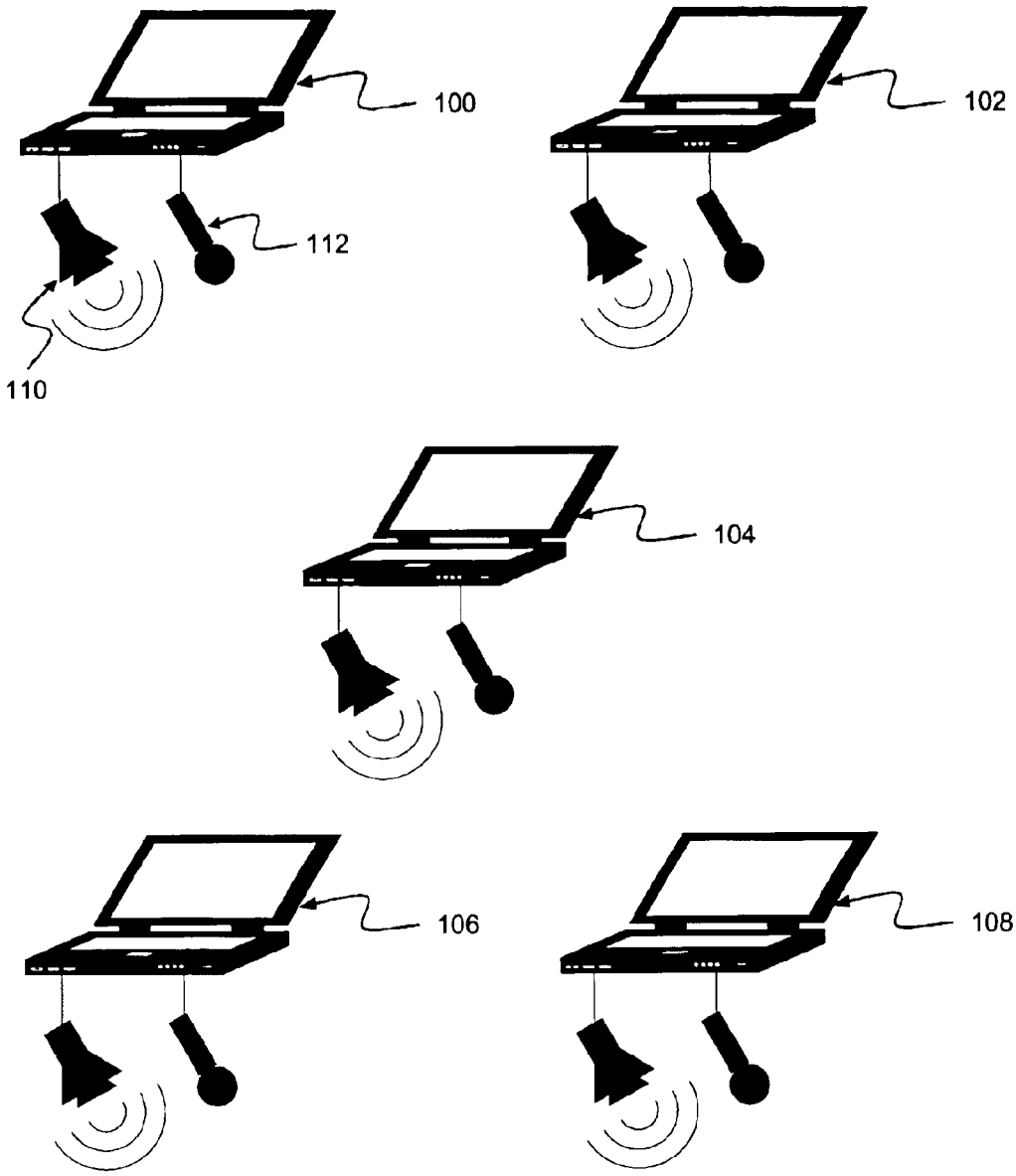
FIG. 1 illustrates a schematic representation of a distributed computing platform consisting of a group of computing devices.

FIG. 1 illustrates a schematic representation of a distributed computing platform consisting of a group of computing devices (100, 102, 104, 106, and 108). The computing devices include a personal computer (PC), laptop, personal digital assistant (PDA), tablet PC, or other computing devices. In one embodiment, each computing device is equipped with audio actuators 110 (E.g speakers) and audio sensors 112 (E.g. microphones). The audio sensors and actuators are utilized to estimate their respective physical locations. In one embodiment these locations can be only calculated as relative to each other. In another embodiment these locations can be with reference to one particular computing device said to be located at the origin of a three-dimensional coordinate system. In one embodiment the computing devices can also be equipped with wired or wireless network communication capabilities to communicate with each other.

Additionally, certain parts of calculations necessary to determine the physical locations of these computing devices can be performed on each individual computing device or performed on a central computing device in different embodiments of the present invention. The central computing device utilized to perform all of the location calculations may be one of the computing devices in the aforementioned group of computing devices in one embodiment. Otherwise, the central computing device is only used for calculations in another embodiment and is not one of the computing devices utilizing actuators and sensors for location calculations.

For example, in one embodiment, given a set of M acoustic sensors and S acoustic actuators in unknown locations, one embodiment estimates their respective three dimensional coordinates. The acoustic actuators are excited using a predetermined calibration signal such as a maximum length sequence or chirp signal, and the time of flight (TOF) of the acoustic signal from emission from the actuator to reception at the sensor is estimated for each pair of the acoustic actuators and sensors. In one embodiment, the TOF for a given pair of actuators and sensors is defined as the time for the acoustic signal to travel from the actuator to the sensor. Measuring the TOF and knowing the speed of sound in the acoustical medium, the distance between each acoustical signal source and the acoustical sensors can be calculated, thereby determining the three dimensional positions of the actuators and the sensors. This only gives a rough estimate of the actual positions of the actuators and sensors due to systemic and statistical errors inherent within each measurement.

Figure 2:
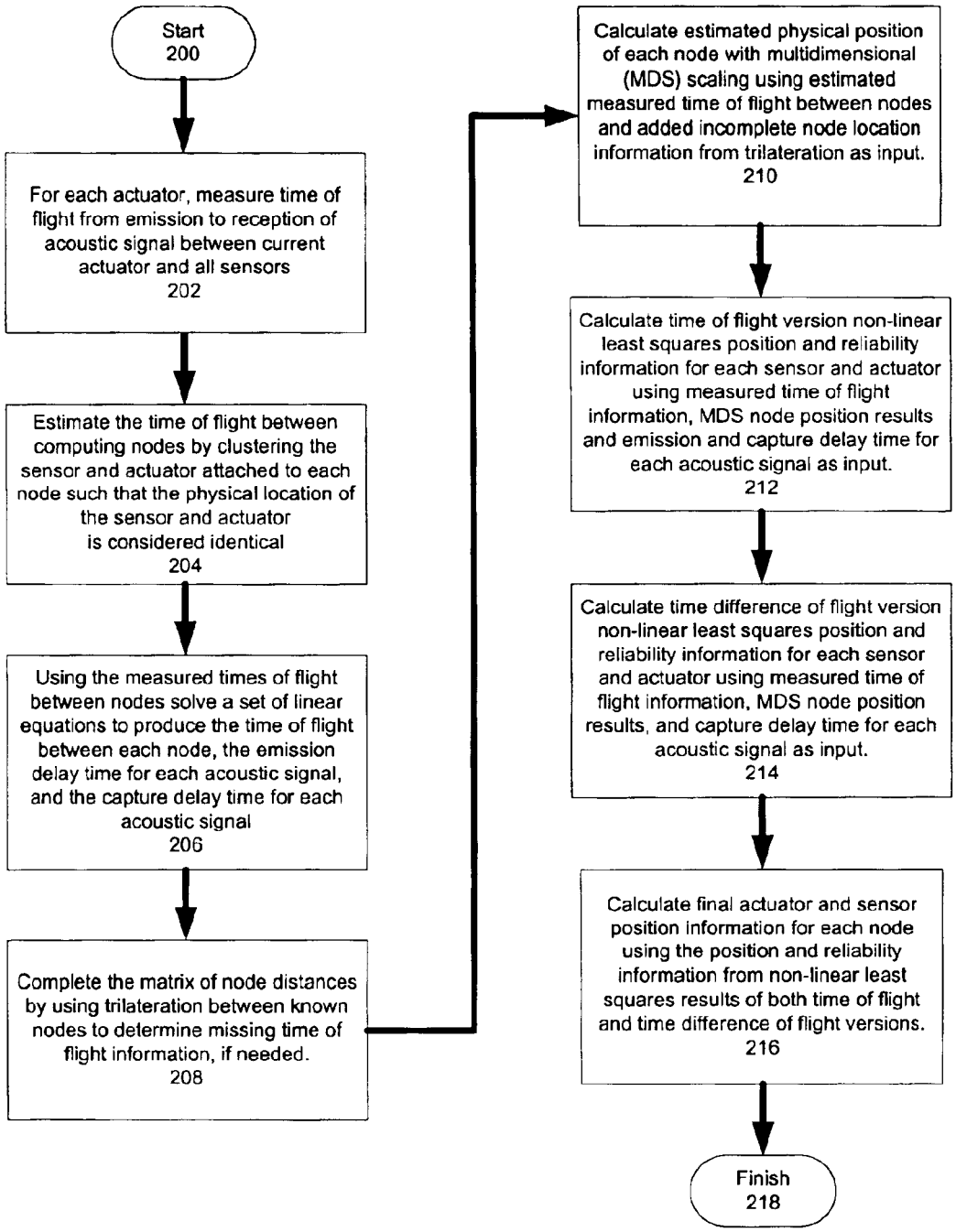
FIG. 2 is a flow diagram describing, in greater detail, the process of generating the three-dimensional position calibration of audio sensors and actuators in a distributed computing platform, according to one embodiment of the present invention.

FIG. 2 is a flow diagram describing, in greater detail, the process of generating the three-dimensional position calibration of audio sensors and actuators in a distributed computing platform, according to one embodiment of the present invention. The flow diagram has a number of steps that are designed to minimize the errors associated with the systemic and statistical errors produced when completing the initial TOF measurements. The process described in the flow diagram of FIG. 2 periodically references the computing devices of the distributed computer platform illustrated in FIG. 1 and refers to each computing device as a node.

Upon starting 200 the process each actuator attached to each computing device node emits an acoustic signal. These signals can be spaced chronologically in one embodiment of the invention. In another embodiment of the invention multiple actuators can emit acoustic signals simultaneously each signal consisting of a unique frequency or unique pattern. In one embodiment, the acoustic signal may be a maximum length sequence or chirp signal, or another predetermined signal. In one embodiment the group of computing device nodes are given a global timestamp from one of the nodes or from a central computing device to synchronize their time and allow accurate TOF measurements between all actuators and all sensors. Then for each node, the TOF is measured between that node and all other nodes (202).

Figure 3:
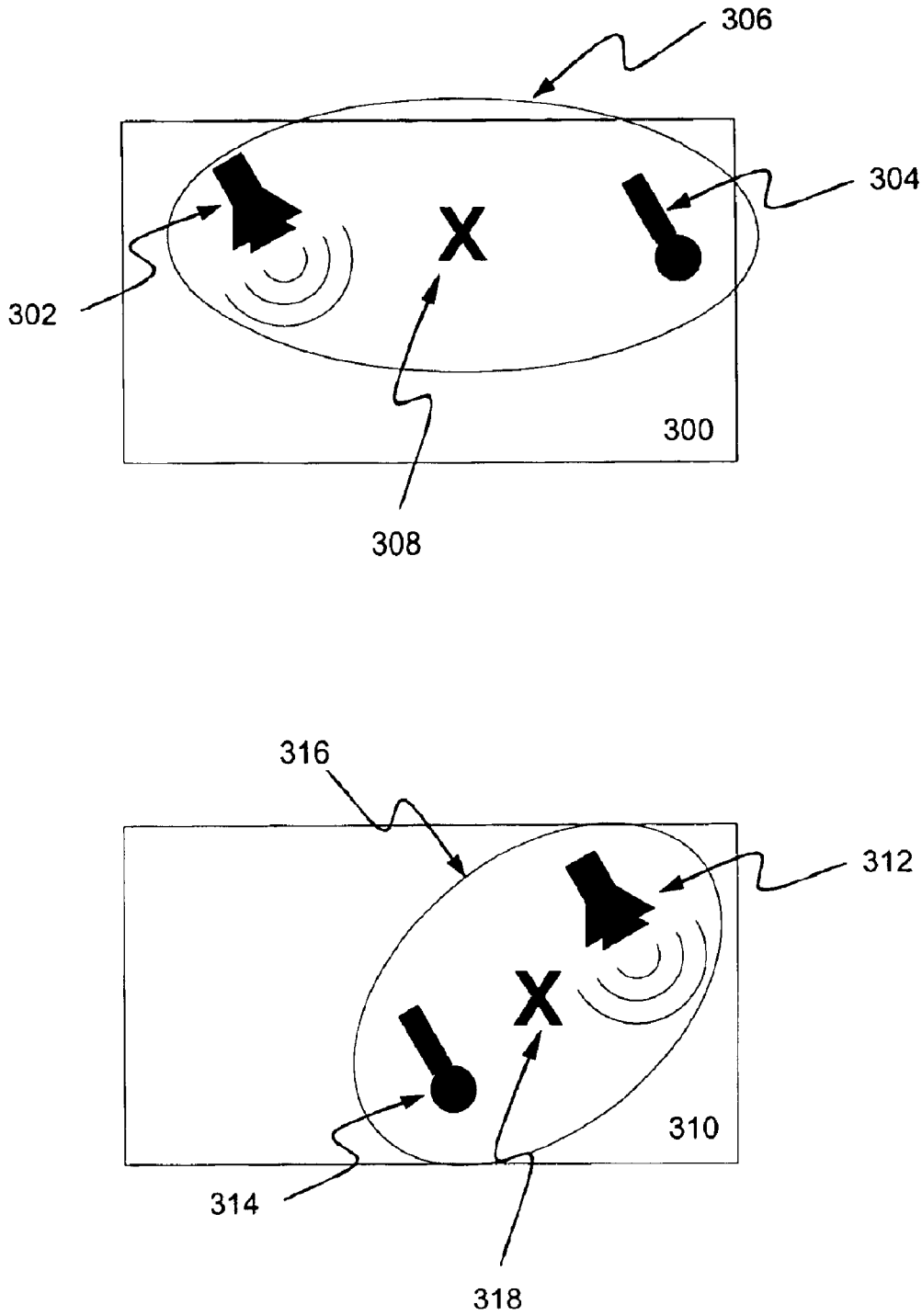
FIG. 3 illustrates the actuator and sensor clustering process in one embodiment of the present invention.

In block 204, the actuator and sensor for each node are clustered together and regarded to be in the same locations. Thus the measured distance (TOFs/(speed of sound)) between two nodes is estimated from the TOF of the actuator of a first node and the sensor of a second node and the TOF of the actuator of the second node and the sensor of the first node. In one embodiment this estimate is the average of the two TOFs. At this point each node is measured as one individual physical location with no distance between the actuator and sensor for each given node. This clustering introduces a limited amount of error into the exact locations of the actuators and sensors but that error is eventually compensated for to achieve precise locations. FIG. 3 illustrates the actuator and sensor clustering process in one embodiment of the present invention. Computing device 300 has an actuator 302 and a sensor 304 located on it. These two devices are clustered 306 with relationship to each other and a central location 308 is calculated to allow for one universal physical location of the actuator 302 and sensor 304 on computing device 300. Additionally, computing device 310 shows another possibility with the actuator 312 and sensor 314 in different locations upon the computing device. Once again the two devices are clustered 316 and a central location 318 is calculated to represent computing device 310. As stated, the discrepancies between the actual physical locations of the actuator and sensor do not pose an issue because adjustments are made to minimize or possibly eliminate these minimal location errors.

Figure 4:
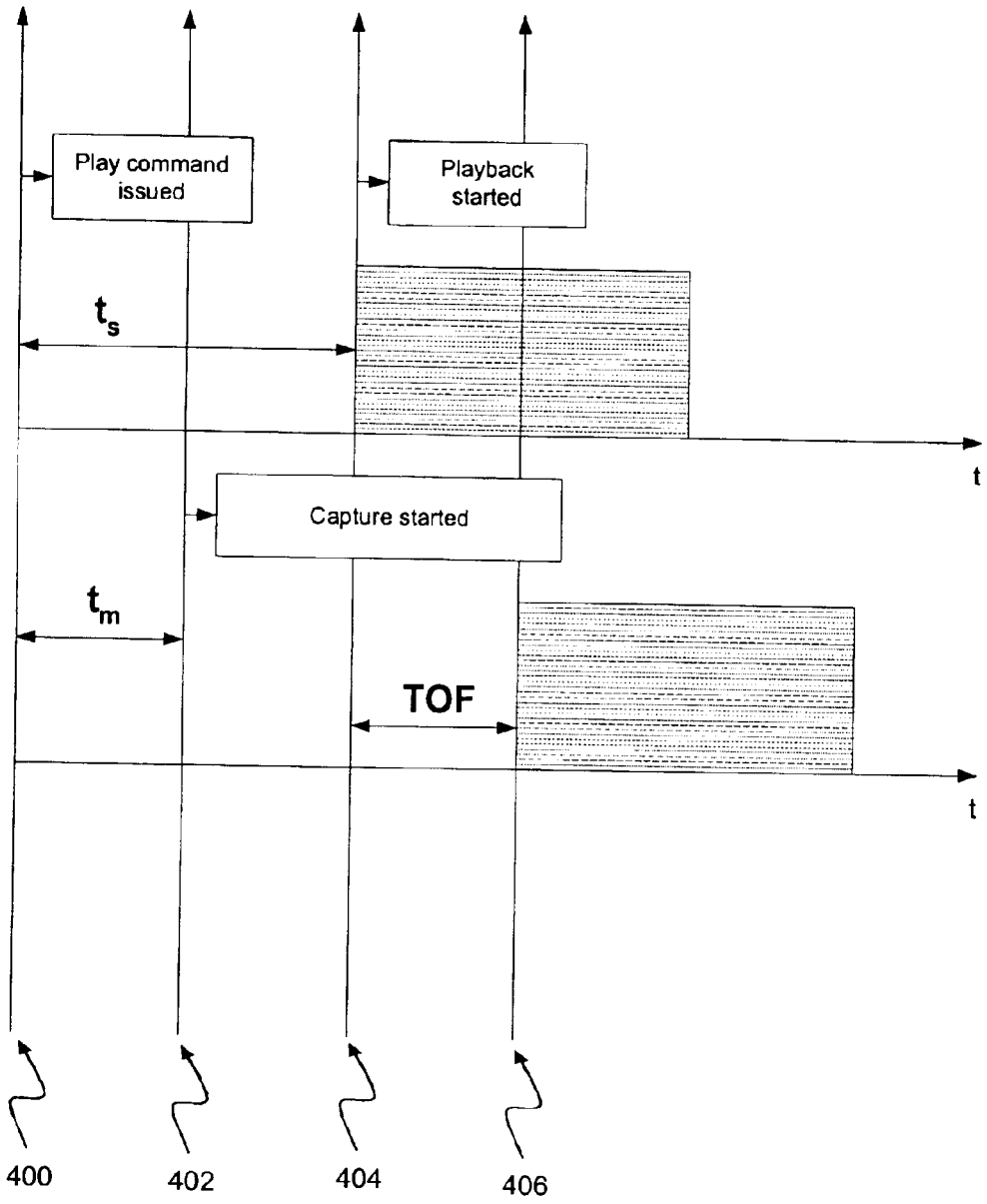
FIG. 4 is an example of a chronological time schematic that isolates $T_s$ and $T_m$ in one embodiment of the present invention.

In block 206 of FIG. 2, a set of linear equations is solved that allows the systemic errors to be estimated from each currently measured TOF to get a more accurate estimation of the TOF between each pair of nodes. The systemic errors that are inherently in each currently measured TOF include the latency associated with actuator emission and the latency associated with capture reception. Computing devices and their actuator and sensor peripherals are fast when executing commands, but not instantaneous. Analog-to-digital and digital-to-analog converters of actuators and sensors of the different nodes are typically unsynchronized. There is a time delay between the time the play/emission command is issued to the actuator and the actual time the emission of the acoustic signal begins (referred to as $T_s$). Furthermore, there also exists a time delay between the time the capture command is issued to the sensor and the actual time the capture/reception of the acoustic signal begins (referred to as $T_m$). $T_s$ and $T_m$ and can actually vary in time depending on the sound card and processor load of the respective computing device node. These two systemic errors ($T_s$ and $T_m$) along with the modified TOF using the clustered positions are solved for using a set of linear equations. FIG. 4 is an example of a chronological time schematic that isolates $T_s$ and $T_m$ in one embodiment of the present invention. At time 400, the play command is issued. In an embodiment of the invention where all nodes can communicate with each other and have synchronized time stamps the play command will also trigger a capture command at the same instant on a second node. The second node must know when to attempt to capture the signal in order to effectively measure the TOF. At time 402, the capture is started on the second node so $T_m$ is equal to time 402 minus time 400. At time 404, the emission is started so $T_s$ is equal to time 404 minus time 400. At time 406, the acoustic signal is finally captured by the second node, which shows that the true TOF, the time the signal needed to travel through the air to get from the actuator to the sensor is time 406 minus time 404. Without compensating for the systemic errors $T_m$ and $T_s$ each node will have a false assumption as to the true TOF.

Figure 5:
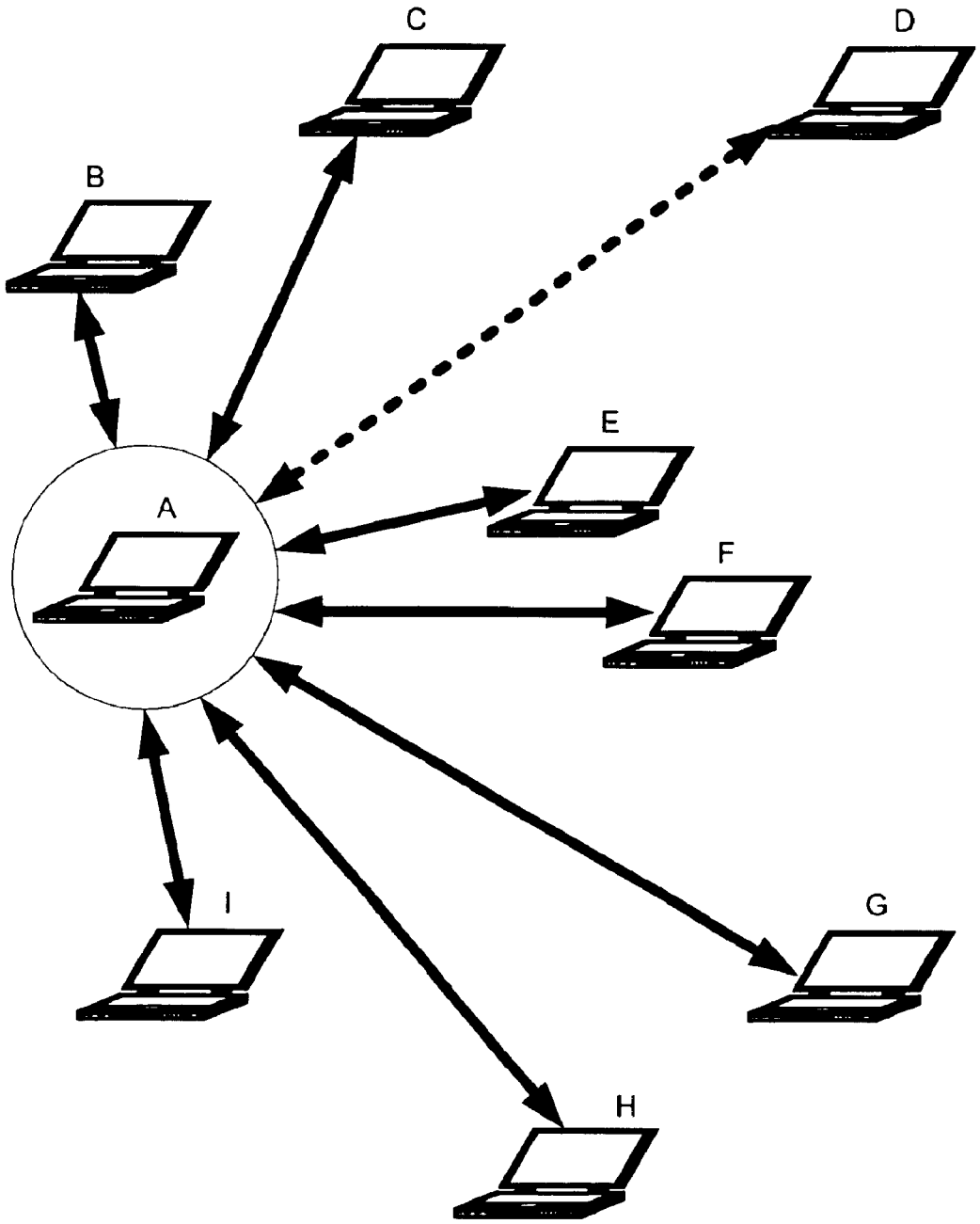
FIG. 5 shows a computing device node which has information regarding the acoustic signal's time of flight (TOF) with respect to multiple nodes in one embodiment of the present invention.

Due to uncertainty in operating conditions of the system as well as external factors it is not uncommon to have certain nodes with incomplete sets of data. In other words, one node might not have the entire set of TOFs for all other nodes. In the case of missing and incomplete data for a node there exists a method to create the rest of the TOFs and subsequent pair-wise node distances. In block 208 of FIG. 2, the missing data points for a given node can be estimated based on current data received through trilateration. As long as a given node with missing information to node X has at least information relating to four other nodes with TOFs to node X in a two-dimensional environment or five other nodes in a three-dimensional environment, an estimate of the TOF of the nodes with missing information can be calculated. FIG. 5 shows a computing device node A which has information regarding the acoustic signal's TOF with respect to nodes B, C, E, F, G, H, and I in one embodiment of the present invention. It is missing information from node D. Considering this to be a three-dimensional scenario, if at least a set of five of the known nodes out of the set of nodes B, C, E, F, G, H, and I have information regarding node D, then using trilateration node A can obtain the information relating to node D.

Once the matrix of pair-wise node TOFs is complete or filled in with as much information as possible the next step in one embodiment of the present invention is to calculate the estimated physical position of every node with multidimensional scaling (MDS) using the set of pair-wise node TOFs in block 210 of FIG. 2. MDS will give estimated coordinates of the clustered center of each node's actuator-sensor pair. In one embodiment one node is set to the origin of the three-dimensional coordinate system and all other nodes are given coordinates relative to the origin. The MDS approach may be used to determine the coordinates from, in one embodiment, the Euclidean distance matrix. The approach involves converting the symmetric pair-wise distance matrix to a matrix of scalar products with respect to some origin and then performing a singular value decomposition to obtain the matrix of coordinates. The matrix coordinates in turn, may be used as the initial guess or estimate of the coordinates for the respective computing device nodes, and the clustered location of the actuator and sensor located on them.

In block 212 of FIG. 2 a TOF-based nonlinear least squares (NLS) computation is used to determine the individual coordinates of the actuator and sensor of each node. In one embodiment, the TOF-based NLS computation considers the TOFs measured in block 202, the MDS coordinate results from block 210, and $T_m$ and $T_s$ from block 206. The NLS computation also reveals a probability assessment that determines the reliability of each node's coordinates using the variance.

In block 214 of FIG. 2 a Time Difference of Flight (TDOF) NLS computation is used to determine the individual coordinates of the actuator and sensor of each node. The TDOF method is unlike the TOF method. In one embodiment a TDOF method uses three nodes per calculation. The first node excites its actuator and an acoustic signal propagates from it. Two separate nodes (the second and third nodes) each receive the acoustic signal from the first node a short time later. In this scenario there are two recorded TOFs, the TOF between the first node and the second node and the TOF between the first node and the third node. The TDOF is the difference in time between the two TOFs. This is a more indirect way of estimating the coordinate system but in many ways more accurate under certain conditions because the difference in reception times only needs to take into account one of the systemic errors, the sensor error Tm. Thus, reducing the number of variables allows for a different but possibly more accurate calculation of node coordinates using TDOF. Therefore, in one embodiment, the TDOF-based NLS computation considers the TDOFs calculated from all TOF measurements in block 202, the MDS coordinate result from block 210, and $T_m$ from block 206. Once again, the NLS computation also reveals a probability assessment that determines the reliability of each node's coordinates using the variance.

Figure 6:
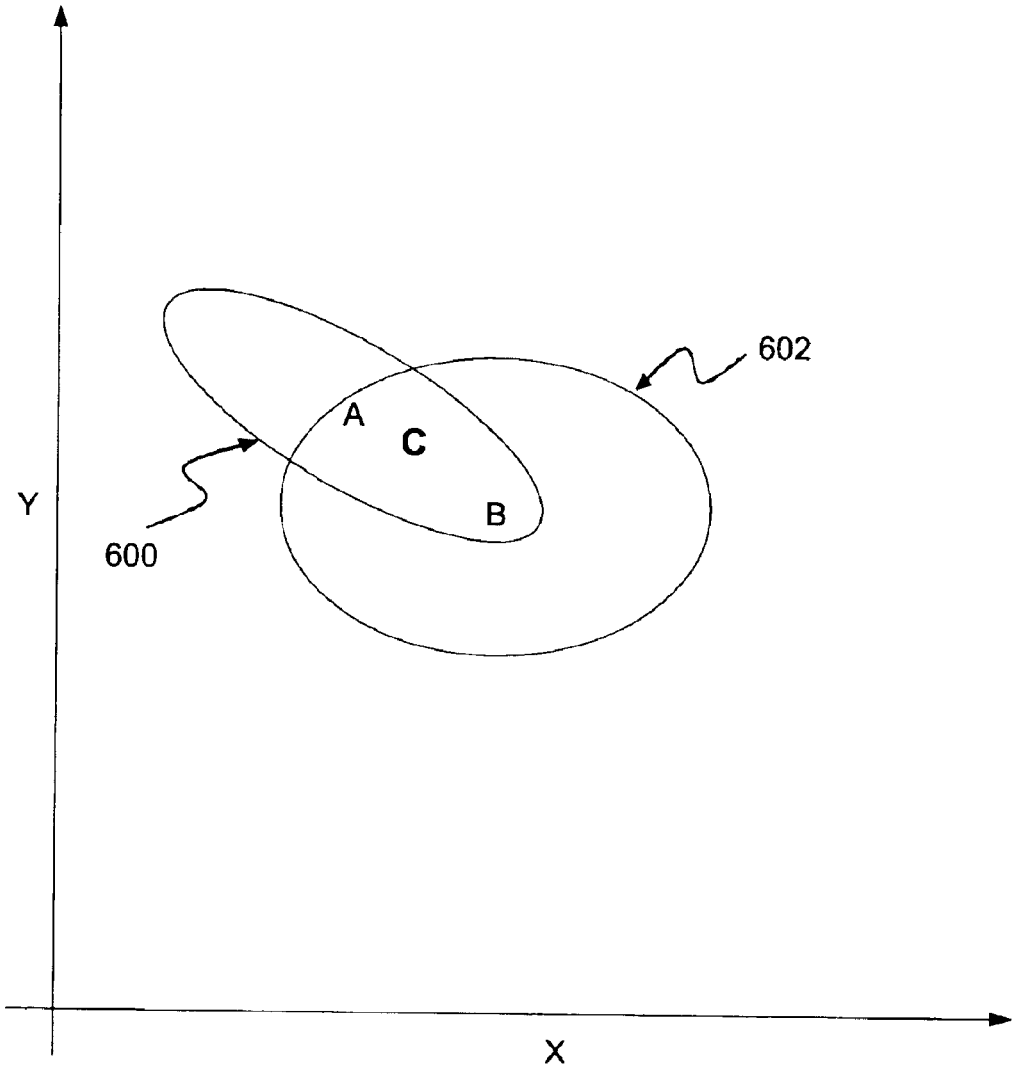
FIG. 6 illustrates the application of the non-linear least squares (NLS) reliability information to the final calculated node coordinates in one embodiment of the present invention.

Finally, in block 216 of FIG. 2, the final coordinates of each individual actuator and sensor on each node are calculated using the coordinate position information and reliability information obtained from the TOF-based NLS computation in block 212 and the TDOF-based NLS computation in block 214 and the process is finished 218. FIG. 6 illustrates the application of the NLS reliability information to the final calculated node coordinates in one embodiment of the present invention. In this example point A is the calculated coordinates obtained from the TOF-based NLS computation and ellipse 600 is the variance that shows the reliability of the TOF-based estimate. Point B is the calculated coordinates obtained from the TDOF-based NLS computation and ellipse 602 is the variance that shows the reliability of the TDOF-based estimate. When combining the coordinates together taking into account the reliability of each set the final calculated physical location ends up as coordinate C. Combining both the TOF-based method with the TDOF-based method creates a more accurate estimated end result.

The techniques described above can be stored in the memory of one of the computing devices as a set of instructions to be executed. In addition, the instructions to perform the processes described above could alternatively be stored on other forms of computer and/or machine-readable media, including magnetic and optical disks. Further, the instructions can be downloaded into a computing device over a data network in a form of compiled and linked version.

Alternatively, the logic to perform the techniques as discussed above, could be implemented in additional computer and/or machine readable media, such as discrete hardware components as large-scale integrated circuits (LSI's), application-specific integrated circuits (ASIC's), firmware such as electrically erasable programmable read-only memory (EEPROM's); and electrical, optical, acoustical and other forms of propagated signals (e.g., carrier waves, infrared signals, digital signals, etc.); etc.

These embodiments have been described with reference to specific exemplary embodiments thereof. It will, however, be evident to persons having the benefit of this disclosure that various modifications and changes may be made to these embodiments without departing from the broader spirit and scope of the embodiments described herein. The specification and drawings are, accordingly, to be regarded in an illustrative rather than a restrictive sense.

What is claimed is:

1. A method, comprising:

generating an acoustic signal from an actuator of a first computing device;

receiving the acoustic signal with a sensor of a second computing device;

receiving the acoustic signal with a sensor of a third computing device;

generating an estimate of a difference between the amount of time required for the acoustic signal to travel from the actuator of the first computing device to the sensor of the second computing device and the amount of time required for the acoustic signal to travel from the actuator of the first computing device to the sensor of the third computing device, wherein the sensors and actuator are unsynchronized; and computing, based on the estimated difference in time, a physical location of at least one of a set including the sensor of the third computing device, the sensor of the second computing device, and the actuator of the first computing device.

2. The method of claim 1, wherein the method further includes:

generating a second acoustic signal from an actuator of the second computing device;

receiving the acoustic signal with a sensor of the first computing device;

receiving the acoustic signal with a sensor of the third computing device;

generating a second estimate of a difference between the amount of time required for the acoustic signal to travel from the actuator of the second computing device to the sensor of the first computing device and the amount of time required for the acoustic signal to travel from the actuator of the second computing device to the sensor of the third computing device, wherein the sensors and actuators are unsynchronized; and computing, based on the second estimated difference in time, a physical location of at least one of a set including the sensor of the third computing device, the sensor of the second computing device, the sensor of the first computing device, the actuator of the second computing device, and the actuator of the first computing device.

3. The method of claim 2, wherein the method further includes:

clustering the estimated locations of the actuator and sensor of each computing device to a single location; and computing an initial estimation of the physical location of each computing device cluster that includes an actuator and a sensor via multidimensional scaling, prior to computing the physical location of at least one of a set including the sensor or actuator of the first computing device, the sensor or actuator of the second computing device, the sensor or actuator of the third computing device, and the sensor or actuator of the fourth computing device.

4. The method of claim 3, wherein the method further includes computing an estimation of the distance between two given computing device clusters, where the amount of time required for an acoustic signal to travel between the two computing device clusters is unknown, by:

locating at least four common additional computing device clusters where the amount of time required for an acoustic signal to travel from each of the at least four additional clusters to each of the two given clusters is known;

estimating an amount of time required for an acoustic signal to travel between the two given clusters by utilizing the known acoustic travel times from each of the at least four common clusters to each of the two given clusters in a trilateration computation via multidimensional scaling.

5. The method of claim 3, further including:

estimating a systemic time delay for each computing device between the initial time a command was issued to capture the acoustic signal and the time when the acoustic signal was actually received via the sensor;

adding the estimated emitting time delay per device into the equation to compute the physical location.

6. The method of claim 5, further including:

computing a first non-linear least squares physical location estimation of an actuator or sensor on a given computing device by using as input a set of information including:

the estimated differences in time required for an acoustic signal to travel from the actuator of the given computing device to the sensors of two other discrete computing devices;

the initial estimate of the physical location of the given computing device via multidimensional scaling; and the estimated receiving systemic time delays.

7. The method of claim 6, further including:

estimating a systemic time delay for each computing device between the initial time a command was issued to emit the acoustic signal and the time when the acoustic signal was actually emitted from the actuator; and adding the estimated emitting time delay per device into the equation to compute the physical location.

8. The method of claim 7, further including:

computing a second non-linear least squares physical location estimation of the same actuator or sensor on a given computing device by using as input a set of information including:

the initial estimates of time required for an acoustic signal to travel from the given computing device actuator to all other known discrete computing device sensors;

the initial estimate of the physical location of the given computing device via multidimensional scaling; and the estimated receiving and emitting systemic time delays.

9. The method of claim 8, further including:

computing the reliability percentage, using non-linear least squares, of the first and second computed physical locations; and computing a final estimated physical location of the actuator or sensor by combining the first and second physical locations and weighting each location according to the computed reliability percentages.

10. The method of claim 9, wherein the acoustic signal is selected from a group comprising of maximum length sequence signal and a chirp signal.

11. The method of claim 1, wherein the method further includes:

receiving the acoustic signal with a sensor of a fourth computing device;

generating a second estimate of a difference between the amount of time required for the acoustic signal to travel from the actuator of the first computing device to the sensor of the fourth computing device and the amount of time required for the acoustic signal to travel from the actuator of the first computing device to the sensor of the second computing device, wherein the sensors and actuator are unsynchronized;

generating a third estimate of a difference between the amount of time required for the acoustic signal to travel from the actuator of the first computing device to the sensor of the fourth computing device and the amount of time required for the acoustic signal to travel from the actuator of the first computing device to the sensor of the third computing device, wherein the sensors and actuator are unsynchronized; and computing, based on the second and third estimated differences in time, a physical location of at least one of a set including the sensor of the fourth computing device, the sensor of the third computing device, the sensor of the second computing device, and the actuator of the first computing device.

12. A machine readable medium having embodied thereon instructions, which when executed by a machine, comprises:

generating an acoustic signal from an actuator of a first computing device;

receiving the acoustic signal with a sensor of a second computing device;

receiving the acoustic signal with a sensor of a third computing device;

generating an estimate of a difference between the amount of time required for the acoustic signal to travel from the actuator of the first computing device to the sensor of the second computing device and the amount of time required for the acoustic signal to travel from the actuator of the first computing device to the sensor of the third computing device, wherein the sensors and actuator are unsynchronized; and computing, based on the estimated difference in time, a physical location of at least one of a set including the sensor of the third computing device, the sensor of the second computing device, and the actuator of the first computing device.

13. The machine readable medium of claim 12, wherein the machine readable medium further includes:

generating a second acoustic signal from an actuator of the second computing device;

receiving the acoustic signal with a sensor of the first computing device;

receiving the acoustic signal with a sensor of the third computing device;

generating a second estimate of a difference between the amount of time required for the acoustic signal to travel from the actuator of the second computing device to the sensor of the first computing device and the amount of time required for the acoustic signal to travel from the actuator of the second computing device to the sensor of the third computing device, wherein the sensors and actuators are unsynchronized; and computing, based on the second estimated difference in time, a physical location of at least one of a set including the sensor of the third computing device, the sensor of the second computing device, the sensor of the first computing device, the actuator of the second computing device, and the actuator of the first computing device.

14. The machine readable medium of claim 13, wherein the machine readable medium further includes:

clustering the estimated locations of the actuator and sensor of each computing device to a single location; and computing an initial estimation of the physical location of each computing device cluster that includes an actuator and a sensor via multidimensional scaling, prior to computing the physical location of at least one of a set including the sensor or actuator of the first computing device, the sensor or actuator of the second computing device, the sensor or actuator of the third computing device, and the sensor or actuator of the fourth computing device.

15. The machine readable medium of claim 14, wherein the machine readable medium further includes computing an estimation of the distance between two given computing device clusters, where the amount of time required for an acoustic signal to travel between the two computing device clusters is unknown, by:

locating at least four common additional computing device clusters where the amount of time required for an acoustic signal to travel from each of the at least four additional clusters to each of the two given clusters is known;

estimating an amount of time required for an acoustic signal to travel between the two given clusters by utilizing the known acoustic travel times from each of the at least four common clusters to each of the two given clusters in a trilateration computation via multidimensional scaling.

16. The machine readable medium of claim 14, further including:

estimating a systemic time delay for each computing device between the initial time a command was issued to capture the acoustic signal and the time when the acoustic signal was actually received via the sensor;

adding the estimated emitting time delay per device into the equation to compute the physical location.

17. The machine readable medium of claim 16, further including:

computing a first non-linear least squares physical location estimation of an actuator or sensor on a given computing device by using as input a set of information including:

the estimated differences in time required for an acoustic signal to travel from the actuator of the given computing device to the sensors of two other discrete computing devices;

the initial estimate of the physical location of the given computing device via multidimensional scaling; and the estimated receiving systemic time delays.

18. The machine readable medium of claim 17, further including:

estimating a systemic time delay for each computing device between the initial time a command was issued to emit the acoustic signal and the time when the acoustic signal was actually emitted from the actuator; and adding the estimated emitting time delay per device into the equation to compute the physical location.

19. The machine readable medium of claim 18, further including:

computing a second non-linear least squares physical location estimation of the same actuator or sensor on a given computing device by using as input a set of information including:

the initial estimates of time required for an acoustic signal to travel from the given computing device actuator to all other known discrete computing device sensors;

the initial estimate of the physical location of the given computing device via multidimensional scaling; and the estimated receiving and emitting systemic time delays.

20. The machine readable medium of claim 19, further including:

computing the reliability percentage, using non-linear least squares, of the first and second computed physical locations; and computing a final estimated physical location of the actuator or sensor by combining the first and second physical locations and weighting each location according to the computed reliability percentages.

21. The machine readable medium of claim 20, wherein the acoustic signal is selected from a group comprising of maximum length sequence signal and a chirp signal.

22. The machine readable medium of claim 12, wherein the machine readable medium further includes:

receiving the acoustic signal with a sensor of a fourth computing device;

generating a second estimate of a difference between the amount of time required for the acoustic signal to travel from the actuator of the first computing device to the sensor of the fourth computing device and the amount of time required for the acoustic signal to travel from the actuator of the first computing device to the sensor of the second computing device, wherein the sensors and actuator are unsynchronized;

generating a third estimate of a difference between the amount of time required for the acoustic signal to travel from the actuator of the first computing device to the sensor of the fourth computing device and the amount of time required for the acoustic signal to travel from the actuator of the first computing device to the sensor of the third computing device, wherein the sensors and actuator are unsynchronized; and computing, based on the second and third estimated differences in time, a physical location of at least one of a set including the sensor of the fourth computing device, the sensor of the third computing device, the sensor of the second computing device, and the actuator of the first computing device.

23. A system, comprising:

a bus;

a processor coupled to the bus;

an audio device coupled to the bus with audio input and output capabilities; and memory coupled to the processor, the memory adapted for storing instructions, which upon execution by the processor generate an acoustic signal from an actuator of a first computing device, receive the acoustic signal with a sensor of a second computing device, receive the acoustic signal with a sensor of a third computing device, generate an estimate of a difference between the amount of time required for the acoustic signal to travel from the actuator of the first computing device to the sensor of the second computing device and the amount of time required for the acoustic signal to travel from the actuator of the first computing device to the sensor of the third computing device, wherein the sensors and actuator are unsynchronized, and compute, based on the estimated difference in time, a physical location of at least one of a set including the sensor of the third computing device, the sensor of the second computing device, and the actuator of the first computing device.

24. The system of claim 23, wherein the system further includes:

generating a second acoustic signal from an actuator of the second computing device;

receiving the acoustic signal with a sensor of the first computing device;

receiving the acoustic signal with a sensor of the third computing device;

generating a second estimate of a difference between the amount of time required for the acoustic signal to travel from the actuator of the second computing device to the sensor of the first computing device and the amount of time required for the acoustic signal to travel from the actuator of the second computing device to the sensor of the third computing device, wherein the sensors and actuators are unsynchronized; and computing, based on the second estimated difference in time, a physical location of at least one of a set including the sensor of the third computing device, the sensor of the second computing device, the sensor of the first computing device, the actuator of the second computing device, and the actuator of the first computing device.

25. The system of claim 24, wherein the system further includes:

clustering the estimated locations of the actuator and sensor of each computing device to a single location; and computing an initial estimation of the physical location of each computing device cluster that includes an actuator and a sensor via multidimensional scaling, prior to computing the physical location of at least one of a set including the sensor or actuator of the first computing device, the sensor or actuator of the second computing device, the sensor or actuator of the third computing device, and the sensor or actuator of the fourth computing device.

26. The system of claim 25, wherein the system further includes computing an estimation of the distance between two given computing device clusters, where the amount of time required for an acoustic signal to travel between the two computing device clusters is unknown, by:

locating at least four common additional computing device clusters where the amount of time required for an acoustic signal to travel from each of the at least four additional clusters to each of the two given clusters is known;

estimating an amount of time required for an acoustic signal to travel between the two given clusters by utilizing the known acoustic travel times from each of the at least four common clusters to each of the two given clusters in a trilateration computation via multidimensional scaling.

27. The system of claim 25, further including:

estimating a systemic time delay for each computing device between the initial time a command was issued to capture the acoustic signal and the time when the acoustic signal was actually received via the sensor;

adding the estimated emitting time delay per device into the equation to compute the physical location.

28. The system of claim 27, further including:

computing a first non-linear least squares physical location estimation of an actuator or sensor on a given computing device by using as input a set of information including:

the estimated differences in time required for an acoustic signal to travel from the actuator of the given computing device to the sensors of two other discrete computing devices;

the initial estimate of the physical location of the given computing device via multidimensional scaling; and the estimated receiving systemic time delays.

29. The system of claim 28, further including:

estimating a systemic time delay for each computing device between the initial time a command was issued to emit the acoustic signal and the time when the acoustic signal was actually emitted from the actuator; and adding the estimated emitting time delay per device into the equation to compute the physical location.

30. The system of claim 29, further including:

computing a second non-linear least squares physical location estimation of the same actuator or sensor on a given computing device by using as input a set of information including:

the initial estimates of time required for an acoustic signal to travel from the given computing device actuator to all other known discrete computing device sensors;

the initial estimate of the physical location of the given computing device via multidimensional scaling; and the estimated receiving and emitting systemic time delays.

31. The system of claim 30, further including:

computing the reliability percentage, using non-linear least squares, of the first and second computed physical locations; and computing a final estimated physical location of the actuator or sensor by combining the first and second physical locations and weighting each location according to the computed reliability percentages.

32. The system of claim 31, wherein the acoustic signal is selected from a group comprising of maximum length sequence signal and a chirp signal.

33. The system of claim 23, wherein the system further includes:

receiving the acoustic signal with a sensor of a fourth computing device;

generating a second estimate of a difference between the amount of time required for the acoustic signal to travel from the actuator of the first computing device to the sensor of the fourth computing device and the amount of time required for the acoustic signal to travel from the actuator of the first computing device to the sensor of the second computing device, wherein the sensors and actuator are unsynchronized;

generating a third estimate of a difference between the amount of time required for the acoustic signal to travel from the actuator of the first computing device to the sensor of the fourth computing device and the amount of time required for the acoustic signal to travel from the actuator of the first computing device to the sensor of the third computing device, wherein the sensors and actuator are unsynchronized; and computing, based on the second and third estimated differences in time, a physical location of at least one of a set including the sensor of the fourth computing device, the sensor of the third computing device, the sensor of the second computing device, and the actuator of the first computing device.

34. The system of claim 23, wherein the actuator is a speaker.

35. The system of claim 23, wherein the sensor is a microphone.

* * * * *